US006224753B1

(12) United States Patent
Marbach

(10) Patent No.: US 6,224,753 B1
(45) Date of Patent: May 1, 2001

(54) WATER CATCHMENT DEVICE FLOATING AT THE SURFACE OF A BASIN AND SUPPLYING A PUMPING SYSTEM

(75) Inventor: Gérard Marbach, Cernay (FR)

(73) Assignee: Sevylor International, Issy les Moulineaux (FR)

( * ) Notice: Subject to any disclaimer, the term of this patent is extended or adjusted under 35 U.S.C. 154(b) by 0 days.

(21) Appl. No.: 09/470,934

(22) Filed: Dec. 22, 1999

(30) Foreign Application Priority Data

Dec. 24, 1998 (FR) ..... 98 16447

(51) Int. Cl.[7] ..... B01D 35/05; B01D 35/147

(52) U.S. Cl. ..... 210/122; 210/130; 210/131; 210/169; 210/242.1; 210/776; 137/578; 137/101.27

(58) Field of Search ..... 210/121, 123, 210/127, 130, 131, 242.1, 169, 100, 122, 776; 137/578, 101.25, 101.27

(56) References Cited

U.S. PATENT DOCUMENTS 3,970,556 * 7/1976 Gore ..... 210/242.1
4,405,458 * 9/1983 McHugh, Jr. ..... 210/242.1
4,802,592 * 2/1989 Wessels ..... 210/242.1
5,133,854 * 7/1992 Horvath ..... 210/121
5,498,348 * 3/1996 Plink et al. ..... 210/242.1

FOREIGN PATENT DOCUMENTS 79928 5/1963 (FR) .
79928 * 2/1997 (FR) .
WO 97/07298 * 2/1997 (WO) ..... E03F/5/14

OTHER PUBLICATIONS

French Preliminary Search Report of the priority French Patent Appplication FR 98 16447, dated Sep. 3, 1999.

* cited by examiner

*Primary Examiner*—Robert Popovics
(74) *Attorney, Agent, or Firm*—Dean W. Russell; Kilpatrick Stockton

(57) ABSTRACT

A water catchment device floating at the surface (19) of a basin comprising: a floating support (1) having a support base (3); and a skimmer (4) retained on the base (3) and comprising a skimmer body (5) which can be vertically displaced above the base (3), the skimmer body (5) having a base (7) which has at least one auxiliary passage (11) designed to be closed off by the base (3) when the skimmer body (5) is resting thereon, and a floating dish (13) which sits at the top of the skimmer body (5) during abnormal operation due to excessive buoyancy caused by inadequate filling with water, in which case the skimmer body becomes buoyant and rises above the base releasing the auxiliary passage (11) by which the water enters the skimmer body, from where it is pumped.

6 Claims, 1 Drawing Sheet

WATER CATCHMENT DEVICE FLOATING AT THE SURFACE OF A BASIN AND SUPPLYING A PUMPING SYSTEM

BACKGROUND OF THE INVENTION

The present invention relates to improvements made to water catchment devices (skimmers) at the surface of a basin, in particular to supply a water filtering system for the basin, and more specifically improvements made to devices of this type which are of a floating design.

The skimmers commonly used in conjunction with water basins such as swimming pools are maintained at a correct level relative to the water surface in the basin by attaching them, possibly adjustably, to a fixed element of the basin (for example a wall, ladder).

However, there is such a thing as a "free" skimmer, i.e. one which is not joined to a fixed element of the basin and which floats on the free surface of the water during normal operation. Since the skimmer is made from materials of a density higher than 1, on the one hand, and the body of the skimmer partially filled with water behaves like a hollow body on the other, it is the level of the water inside the body of the skimmer which determines the relative degree of rising and sinking vertical forces to which the skimmer is subjected and determines whether the skimmer is "buoyant" or "sinking" (or "skimming").

More specifically, the water level inside the skimmer body varies, in particular depending on the suction rate of the pump and disruptions affecting the intake of water to the skimmer body (for example extensive clogging of the filter basket, jamming of the floating dish above the water level, etc.).

If an imbalance occurs in the flow of water across the skimmer and the rate at which water flows by gravity through its inlet into the skimmer body is reduced or even halted (by an obstruction at the inlet screen, for example) and becomes lower than the rate at which water is sucked in by the pump, the skimmer body empties and the pump fails.

SUMMARY OF THE INVENTION

Accordingly, the objective of the invention is to overcome this drawback and propose an improved design for a floating device of this type so that even if the water entering the skimmer body by gravity is reduced or interrupted, the pump can not shut down, the improved device nevertheless remaining simple in structure and made from parts which are easy and inexpensive to manufacture, and such that operation of the device will require no intervention to switch from one operating mode in a normal situation to another operating mode in an abnormal situation or in the event of deterioration.

To this end, the invention proposes a water catchment device which floats at the water surface of a basin, in particular to supply a water filtering system, comprising:

a floating support having a support base and a skimmer arranged inside said floating support and retained on said base, this skimmer comprising:

a skimmer body provided with stop means designed to allow restricted vertical displacement thereof above the base, the skimmer body having a base which has a central main orifice which can be connected to a pumping means and which has at least one auxiliary passage designed to be closed off by said base when the skimmer body is resting thereon and a floating dish which sits at the top of the skimmer body and which is provided with an axial opening.

A device of this type overcomes the disadvantages outlined above and prevents the pump from shutting down:

a) when the device is functioning normally, the floating dish is maintained below the water level of the basin and takes in through its axial opening a lamellar flow of water which falls into the skimmer body before being drawn in through the main orifice under the action of the pumping means whilst the skimmer body, partially filled with water, is "skimming" and is held down against the base: the auxiliary passage provided in the base of the skimmer body is therefore closed off by the base;

b) during abnormal operation when the skimmer body has excessive buoyancy because it is not filling up with water, it becomes "buoyant" and raises the floating dish above the water level of the basin, cutting off the intake of water into the skimmer: the skimmer body will then rise above the base, releasing the auxiliary passage so that the water from the basin can penetrate the body via said auxiliary passage thus released and is drawn in through the central orifice by the pumping means.

In one particular embodiment, the base has an annular plate in which a connector linking the skimmer body to the pumping means loosely engages, a free space being left between said connector and the inner edge of the annular plate for the reflux of water from the basin when the device is operating under abnormal conditions. The base can then be provided with at least one member protruding radially from the periphery of the annular plate towards the interior to form a stop that will retain the skimmer body vertically; it is of practical use if the protruding member is an annular wing and the base is of a [ shape in cross section.

Advantageously, if the skimmer body is made from a low density material, such as a low density plastic, for example, the skimmer body may be provided with a ballast so that its density becomes substantially greater than 1.

BRIEF DESCRIPTION OF THE DRAWINGS

The invention will be more readily understood from the detailed description of a preferred embodiment, which is given solely by way of example and is not restrictive in any respect. Throughout the description, reference will be made to the appended drawings in which FIGS. 1 and 2 provide schematic illustrations, in section, of a preferred embodiment of a device having the design proposed by the invention and showing two different operating situations respectively.

DETAILED DESCRIPTION OF THE INVENTION

Figure 1:
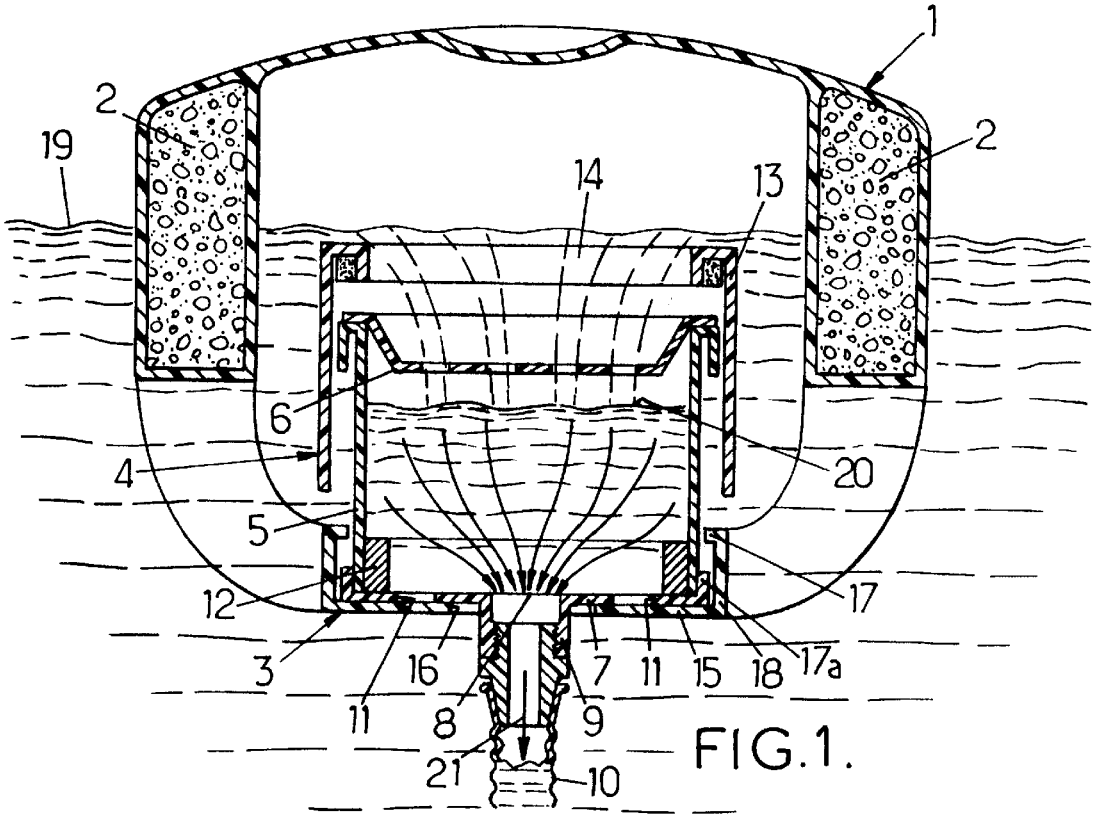

FIG. 1 illustrates a water catchment device floating on the free water surface of a basin such as a swimming pool, specifically designed to supply a water filtering system for the basin. Such devices are commonly referred to as skimmers or incorporate a skimmer.

The device illustrated in FIG. 1 has a floating support 1, which is designed in any manner that will enable it to float at the surface of the basin (due to the choice of materials; inclusion or one or more floats 2 made from a material with a density substantially less than 1, for example foam).

The floating support 1 has a base 3 designed to accommodate, inside said support 1, a skimmer which is denoted as a whole by reference number 4.

The skimmer 4 has a skimmer body 5 in the shape of a box which is open at the top. As a general rule, a screen 6 rests on the top edge of the skimmer body, designed to hold back any coarse debris (leaves, paper, branches, . . .) The skimmer body 5 has a base 7 provided with a main orifice at the centre to give access to a connector 9 for attaching a flexible hose 10 providing a connection to pumping and filtering means (not illustrated), in principle located externally to the basin.

Furthermore, the base 7 of the skimmer body 5 is provided with one or more auxiliary passages 11 arranged between the main orifice 8 and the peripheral edge.

The skimmer body is constructed in such a way that it is of a density that is close to but substantially greater than 1 so that it will naturally "skim". It may be made from a material that will produce this effect or alternatively it may be made from a material whose density is substantially less than 1 and weighted, for example by means of a ballast ring 12 which, in the embodiment illustrated, rests on its base and conforms to the internal contour as illustrated in FIG. 1.

The skimmer body 5 has at its head a dish 13 of a density slightly less than 1 and hence naturally "buoyant". The floating dish 13 may be made from a material of a density slightly less than 1 or, alternatively, made by made from a material with a density greater than 1 and provided with a float means such as a foam ring as illustrated in FIG. 1. At the top, this dish 13 has an axial opening 14 constituting a water inlet to the skimmer.

The above-mentioned base 3 has an annular plate 15 located underneath the base of the skimmer and provided with a central orifice 16 in which the connector 9 joined to the base 7 of the skimmer body engages. A free space 16*a* is left between the edges of the orifice 16 and the connector 9 inserted in it.

Located at a distance above the plate is a radially extending stop member directed towards the interior, designed to limit the degree of vertical displacement of the skimmer body 5 above the annular plate 15. Advantageously, the stop member 17 is an annular wing parallel with the plate 15 and joined to it by means of a vertical skirt 18 so that the base is of a λ shape in cross section.

Co-operating with the stop member 17 and provided on the skimmer body 5 is a radial protrusion 17*a* which may be the periphery, for example, and may be a peripheral zone of the base 7 extending beyond the side wall of the skimmer body 5.

The device operates in the following manner.

When operating under normal conditions (see FIG. 1), the floating dish 14 is located immediately below the free surface of the water in the basin 19, in equilibrium under the action of the different forces to which it is subjected. The floating dish may therefore follow slow variations in the free surface 19 allowing a lamellar flow of water to flow into the skimmer body, entraining debris floating on the free surface 19 with it, due to the surface effect.

The water drops through the screen 6 into the skimmer body, which it fills up to a level 20 whilst being drawn by the pumping means through the outlet orifice 8 (arrow 21).

Under these normal operating conditions, the skimmer body is "skimming" and rests on the annular plate 15 of the base 3, which is in turn supported at a predetermined distance below the free level 19 due to the floats 2 of the support 1. In this position, the auxiliary passage or passages 11 provided in the base of the skimmer body 5 are closed off by the annular plate 15 of the base 3.

Figure 2:
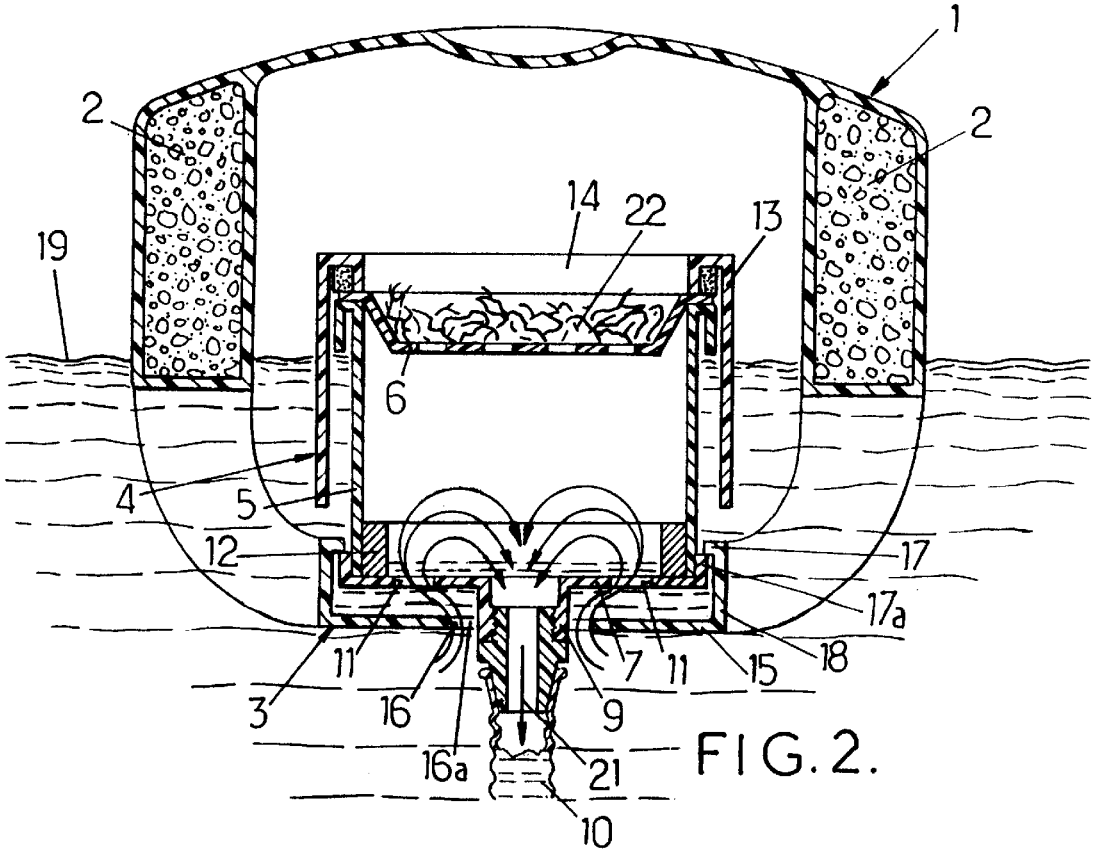

When operating under abnormal conditions or in the event of deterioration when water is no longer flowing into the skimmer body or is not flowing into it at an adequate rate, due to debris 22 obstructing the screen for example (see FIG. 2), the output flow rate of the water from the skimmer body imposed by the pumping means will cause the skimmer body to run dry sooner or later.

The skimmer body, almost empty, then becomes "buoyant" and rises above the annular plate 15 until it comes to a stop against the annular retaining wing 17, driving with it the floating dish, the top edge of which moves above the free surface 19.

In this situation, the auxiliary passage or passages 11 are released and the water from the basin passes through the free space 16*a* and these passages 11 into the skimmer body, where it is drawn by the pumping means through the outlet orifice 8.

The weight of the ballast 12 can be determined so that the skimmer body is raised and the auxiliary passages 11 released whilst a small quantity of water, introduced normally via the opening 14 in the floating dish, remains inside the skimmer body.

Accordingly, the skimmer body will be prevented from drying out completely, thereby avoiding a resultant shutdown of the pumping means and the associated risk of damage or even total failure thereof.

The means of implementation remain structurally simple and above all require no manual intervention to switch from operation under normal conditions to operation under abnormal conditions.

Finally, the various component parts are simple and inexpensive to manufacture (from moulded plastic, for example) and the price of a floating device of this design can be kept relatively modest.

I claim:

1. A water catchment device which floats at the surface of a basin, comprising:

a floating support having a support base and a skimmer arranged inside said floating support and retained on said base, this skimmer comprising:

a skimmer body provided with stop means designed to allow restricted vertical displacement thereof above the base, the skimmer body having a screen atop thereof and a base which has a central main orifice which can be connected to a pumping means and which has at least one auxiliary passage designed to be closed off by said base when the skimmer body is resting thereon and a floating dish which sits at the top of the skimmer body and which is provided with an axial opening, wherein:

during normal operation, the floating dish is located slightly below the water level of the basin and takes in through its axial opening a lamellar flow of water which falls into the skimmer body before being drawn through the main orifice under the action of the pumping means whilst the skimmer body is held down against the base and the auxiliary passage provided in the base thereof is closed off by the base, and during abnormal operation, caused by excessive buoyancy due to inadequate filling with water, the skimmer body becomes "buoyant" and raises the floating dish above the water level of the basin, cutting off the intake of water into the skimmer, whilst the auxiliary passage is released and the water from the basin can penetrate the body via the auxiliary passage and can then be drawn in through the central orifice by the pumping means.

2. A device as claimed in claim 1, wherein the base has an annular plate in which a connector providing a link to the pumping means loosely engages, a free space being left between said connector and the inner edge of the annular plate for the reflux of water from the basin when the device is operating abnormally.

3. A device as claimed in claim 2, wherein the base also has at least one member protruding radially from the periphery of the annular plate towards the interior to form a vertical retaining stop for the skimmer body.

4. A device as claimed in claim 2, wherein the base also has at least one member protruding radially from the periphery of the annular plate towards the interior to form a vertical retaining stop for the skimmer body and wherein the protruding member is an annular wing and the base is of a [ shape in cross section.

5. A device as claimed in claim 1, wherein the skimmer body is provided with a ballast so that the density of the skimmer body is substantially greater than 1.

6. A device as claimed in claim 1, which supplies a water filtering system.

* * * * *